US011517171B2

(12) United States Patent
Hamilton

(10) Patent No.: US 11,517,171 B2
(45) Date of Patent: Dec. 6, 2022

(54) DETAILING TOOL

(71) Applicant: Lilly Brush Co., LLC, Englewood, CO (US)

(72) Inventor: Elsie Cryder Hamilton, Englewood, CO (US)

(73) Assignee: LILLY BRUSH CO., LLC, Englewood, CO (US)

( * ) Notice: Subject to any disclaimer, the term of this patent is extended or adjusted under 35 U.S.C. 154(b) by 8 days.

(21) Appl. No.: 16/522,914

(22) Filed: Jul. 26, 2019

(65) Prior Publication Data

US 2021/0022580 A1 Jan. 28, 2021

(51) Int. Cl.
*A47L 13/00* (2006.01)
*A47L 13/11* (2006.01)

(52) U.S. Cl.
CPC ..... *A47L 13/11* (2013.01)

(58) Field of Classification Search
CPC . A47L 13/12; A47L 1/06; A47L 13/11; A47L 13/08; B60S 3/045; A47J 43/288
USPC ..... 15/320, 245, 340.1, 401
See application file for complete search history.

(56) References Cited

U.S. PATENT DOCUMENTS

| | | | |
|---|---|---|---|
| D19,979 | S | 7/1890 | Spruill |
| 532,462 | A | 1/1895 | Humphrey |
| D32,484 | S | 4/1900 | Bowles |
| 1,388,282 | A | 8/1921 | Meredith |
| 1,804,415 | A | 5/1931 | Leonard |
| 2,380,855 | A | 7/1945 | Lower |
| 2,637,893 | A | 5/1953 | Shaw |
| 3,087,223 | A | 4/1963 | Raw |
| 3,120,019 | A | 2/1964 | Scott |
| 3,230,566 | A | 1/1966 | Willard |
| D208,190 | S | 8/1967 | Parry |
| 3,765,046 | A | 10/1973 | Tsuruzawa |
| D229,160 | S | 11/1973 | Kuzma |

(Continued)

FOREIGN PATENT DOCUMENTS

| | | |
|---|---|---|
| EP | 2289637 A1 | 3/2011 |
| GB | 2191392 A | 12/1987 |
| GB | 2085421 | 7/1999 |

OTHER PUBLICATIONS

"Pill (textiles)", http://en.wikipedia.org/wiki/Pill_textile, accessed Jan. 4, 2018.

(Continued)

*Primary Examiner* — Katina N. Henson
(74) *Attorney, Agent, or Firm* — Thompson Coburn LLP

(57) ABSTRACT

A detailing tool for removing unwanted particles from a target surface. The detailing tool includes a tool head and a pair of blades. The tool head extends longitudinally between a front side and a rear side, the front side being opposite the rear side. The tool head further extends transversely between a first end and a second end, the first end being opposite the second end. The tool head is adapted and configured to receive a plastic unitary one piece member. The pair of blades includes a rearward blade and a forward blade, the pair of blades being formed from the unitary one piece member. When the unitary one piece member is received within the tool head, the pair of blades are adapted and configured to flex and engage the target surface such that unwanted particles adhere to the pair of blades and are removed from the target surface.

14 Claims, 8 Drawing Sheets

(56) References Cited

U.S. PATENT DOCUMENTS

| | | | | |
|---|---|---|---|---|
| D241,603 | S | 9/1976 | MacNeil | |
| 4,042,995 | A | 8/1977 | Varon | |
| D254,703 | S | 4/1980 | Seres | |
| D261,601 | S | 11/1981 | Kettlestrings | |
| D269,944 | S | 8/1983 | Young | |
| 4,639,965 | A | 2/1987 | Suzuki | |
| D332,160 | S | 12/1992 | Kuzma | |
| D339,889 | S | 9/1993 | Kessler et al. | |
| D343,559 | S | 1/1994 | Liberty | |
| D348,986 | S | 7/1994 | Ross | |
| 5,377,382 | A * | 1/1995 | Bores | A47L 11/4044 15/245 |
| D358,011 | S | 5/1995 | Decarli | |
| D358,491 | S | 5/1995 | Hoagland | |
| 5,467,495 | A | 11/1995 | Boland et al. | |
| D401,243 | S | 11/1998 | Gulladauro | |
| D401,595 | S | 11/1998 | Gulladauro | |
| 5,850,660 | A | 12/1998 | O'Halloran | |
| 6,086,373 | A | 7/2000 | Schiff et al. | |
| 6,094,777 | A * | 8/2000 | Windmeisser | A47L 9/06 15/245 |
| D459,088 | S | 6/2002 | Rowe et al. | |
| D477,700 | S | 7/2003 | Chezzi | |
| D503,316 | S | 3/2005 | Webb et al. | |
| 6,901,622 | B2 | 6/2005 | Thompson et al. | |
| D511,873 | S | 11/2005 | Vitantonio et al. | |
| D513,813 | S | 1/2006 | Avery | |
| D514,763 | S | 2/2006 | Lyall, III et al. | |
| D557,021 | S | 12/2007 | Zemel | |
| D557,901 | S | 12/2007 | Zemel | |
| D567,511 | S | 4/2008 | Borovicka et al. | |
| 7,503,093 | B2 | 3/2009 | Weihrauch | |
| D593,755 | S | 6/2009 | Mendez et al. | |
| D597,740 | S | 8/2009 | Borovicka et al. | |
| 7,644,466 | B2 | 1/2010 | Weihrauch et al. | |
| D624,720 | S | 9/2010 | Motsenbocker | |
| 7,870,639 | B2 * | 1/2011 | Thomas | A47L 11/4044 15/322 |
| D664,363 | S | 7/2012 | Rothman | |
| D704,451 | S | 5/2014 | Schouten et al. | |
| D706,109 | S | 6/2014 | McGarrity | |
| D712,608 | S | 9/2014 | Crawley | |
| D741,605 | S | 10/2015 | Witzel et al. | |
| D825,192 | S | 8/2018 | Duvall | |
| 2007/0074361 | A1 * | 4/2007 | Gavney | A47L 11/4088 15/121 |
| 2009/0110894 | A1 | 4/2009 | Nybakken et al. | |
| 2010/0293733 | A1 | 11/2010 | Hebebrand | |
| 2011/0258790 | A1 | 10/2011 | Cole | |
| 2012/0311800 | A1 | 12/2012 | Lew | |
| 2018/0070790 | A1 * | 3/2018 | Weaver | A47L 13/11 |
| 2018/0110385 | A1 * | 4/2018 | Buss | A47L 7/0009 |

OTHER PUBLICATIONS

"USU Extension: Caring for Your Sweaters", Jan. 24, 2008, http://studio5.ksl.com/?nid=58&SID=2535009.

Autogeek, "Lilly Brush Pet Hair Detailer", <https://www.autogeek.net/lilly-pet-hair-brush.html>, accessed Sep. 19, 2018.

Machine translation of EP2289637A1, 2011.

Somitape, "Sh102 High Performance Hand-Held Cotton Squeegee", MadeInChina website, <https://somitape.en.made-in-china.com/...a-Somitape-Sh102-High-Performance-Hand-Held-Cotton-Squeegee-for-Cleaning-and-Printing.html>, accessed Sep. 19, 2018.

YouTube, "Lilly Brush Pet Hair Detailer", Aug. 15, 2017, site visited Sep. 3, 2018, <https://www.youtube.com/watch?v=v1SViJzs7WM>, 2 pages.

* cited by examiner

DETAILING TOOL

BACKGROUND AND SUMMARY

This disclosure pertains to a detailing tool for removing unwanted particles from a target surface.

One aspect of the disclosure pertains to a detailing tool, which may be used for removing unwanted particles or water droplets from a target surface. The detailing tool includes a tool head, a retaining bar and a flexible blade member that forms a pair of blades. The tool head extends longitudinally between a front side and a rear side, the front side being opposite the rear side. The tool head further extends transversely between a first end and a second end, the first end being opposite the second end. The tool head is adapted and configured to receive a flexible blade member that forms the pair of blades once assembled with the tool head. The pair of blades includes a rearward blade and a forward blade. When the flexible blade member is received within the tool head, the pair of blades are adapted and configured to flex and engage the target surface such that unwanted particles adhere to the pair of blades and are removed from the target surface.

Another aspect of the disclosure pertains to a detailing tool including a tool head, a retaining bar, and a flexible blade member that forms a pair of blades. The tool head extends longitudinally between a front side and a rear side, the front side being opposite the rear side. The tool head further extends transversely between a first end and a second end, the first end being opposite the second end. The tool head may include a cavity. The cavity may extend between the first end and the second end and between the front side and the rear side. The cavity may be adapted and configured to receive a flexible blade member. The retaining bar may be adapted and configured to be inserted into the cavity and releasably secured to the tool head using one or more fasteners. The flexible blade member is sufficiently flexible such when it flexed and engaged against the tool head with the retaining bar, the flexible blade member forms a pair of blades. The pair of blades includes a rearward blade and a forward blade. The pair of blades may project from the cavity of the tool head. The retaining bar has a curved upper surface, a straight rearward surface extending downwardly from the curved upper surface, and a straight forward surface extending downwardly from the curved upper surface opposite the straight rearward surface. The flexible blade member curves around the curved upper surface of the retaining bar and is positioned between the retaining bar and the tool head. The flexible blade member is sandwiched between the retaining bar and tool head such that the rearward blade is between the rearward surface of the retaining bar and a portion of tool head defining the rear side and the cavity. The flexible blade member is also sandwiched between the retaining bar and tool head such that the forward blade is between the forward surface of the retaining bar and a portion of the tool head defining the front side and the cavity. The pair of blades is adapted and configured to flex and engage the target surface such that unwanted particles adhere to the pair of blades and are removed from the target surface.

Another aspect involves a method. In accordance with one step of the method, a tool head is provided. The tool head has a front side and a rear side spaced apart from the front side across a width of the tool head, and the tool head has a first end and a second end spaced apart from the first end across a length of the tool head. In accordance with another step of the method, a flexible blade member is provided. In accordance with another step of the method, a retaining member is provided. The retaining member is adapted and configured to releasably connect with the tool head and releasably secure the flexible blade member to the tool head. In another step of the method, the flexible blade is releasably secured to the tool head and first and second blades are formed by flexing the flexible blade around the retaining member and releasably connecting the retaining member to the tool head with the flexible blade member engaged against the tool head such that the first and second flexible blades project from the tool head and extend along a direction corresponding to the length of the tool head with the first blade spaced apart from the second blade along a direction corresponding to the width of the tool head.

Further features and advantages of the present disclosure, as well as the operation of the embodiments described herein, are described in detail below with reference to the accompanying drawings.

Figure 1:
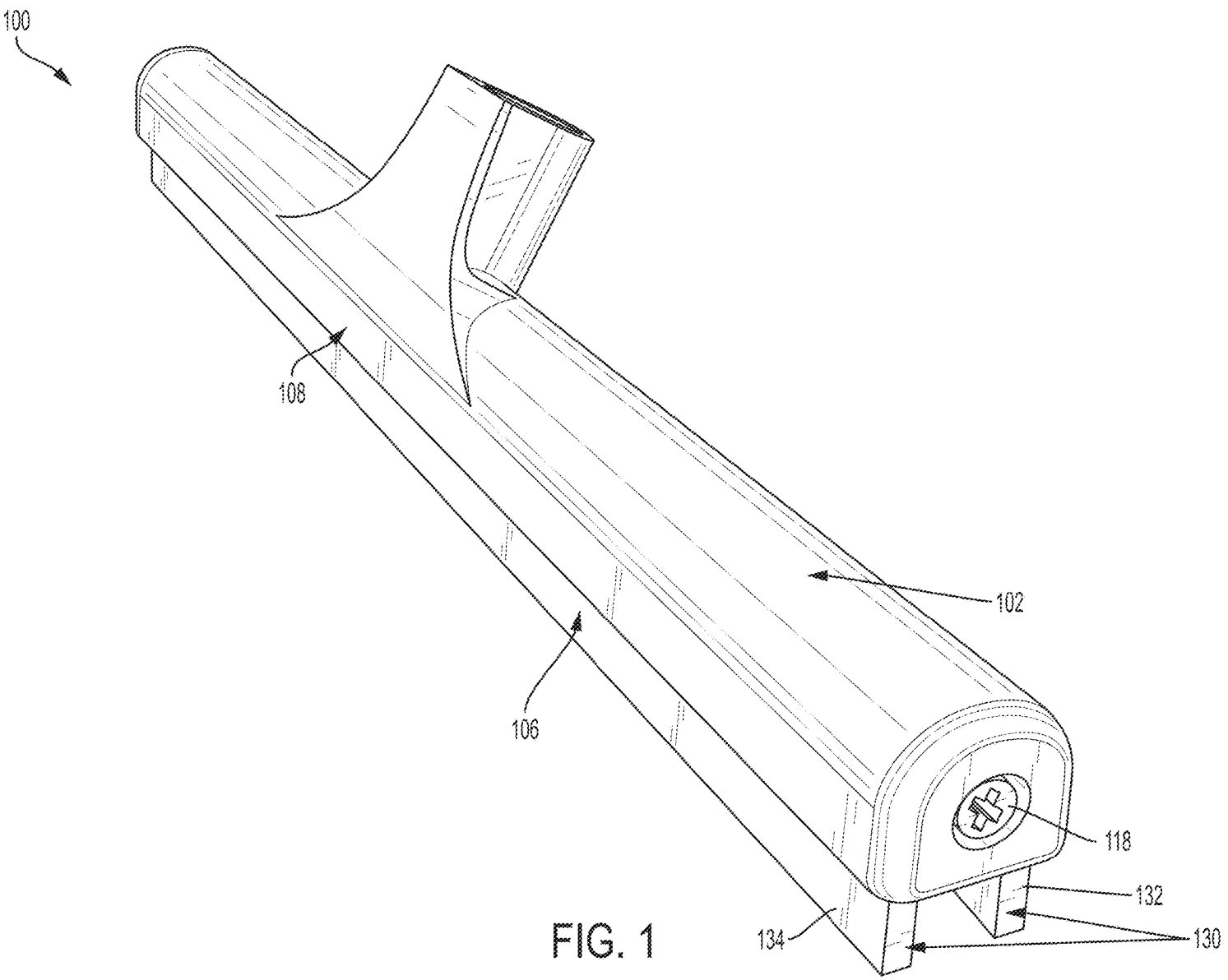
FIG. 1 is a perspective view of an exemplary embodiment of a detailing tool in accordance with the present disclosure with a retaining member and a flexible blade member forming a pair of blades installed in a tool head of the detailing tool.
Figure 2:
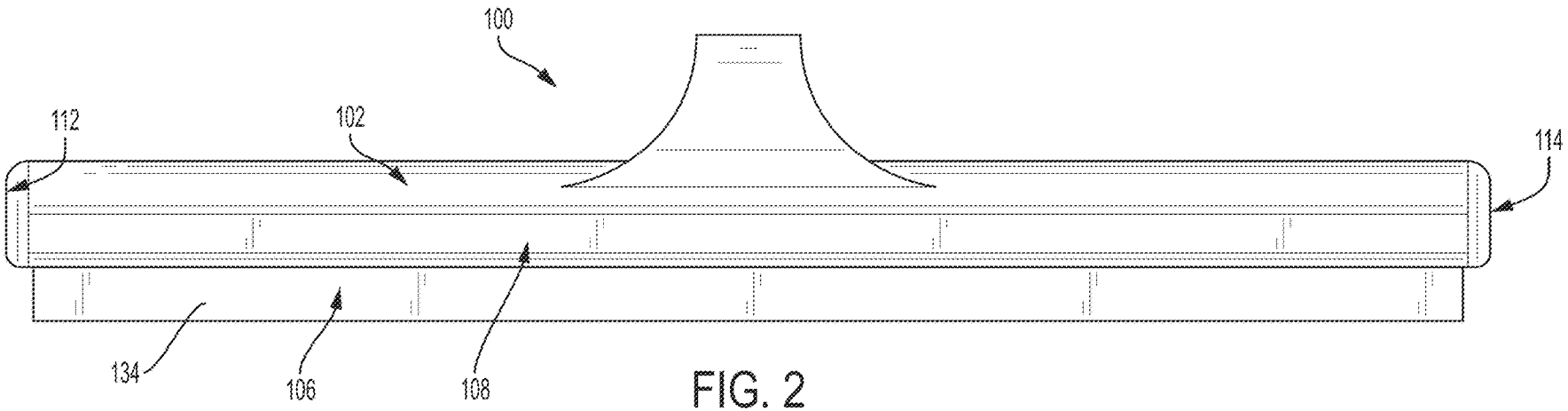
FIG. 2 is a front view of the detailing tool shown in FIG. 1.
Figure 3:
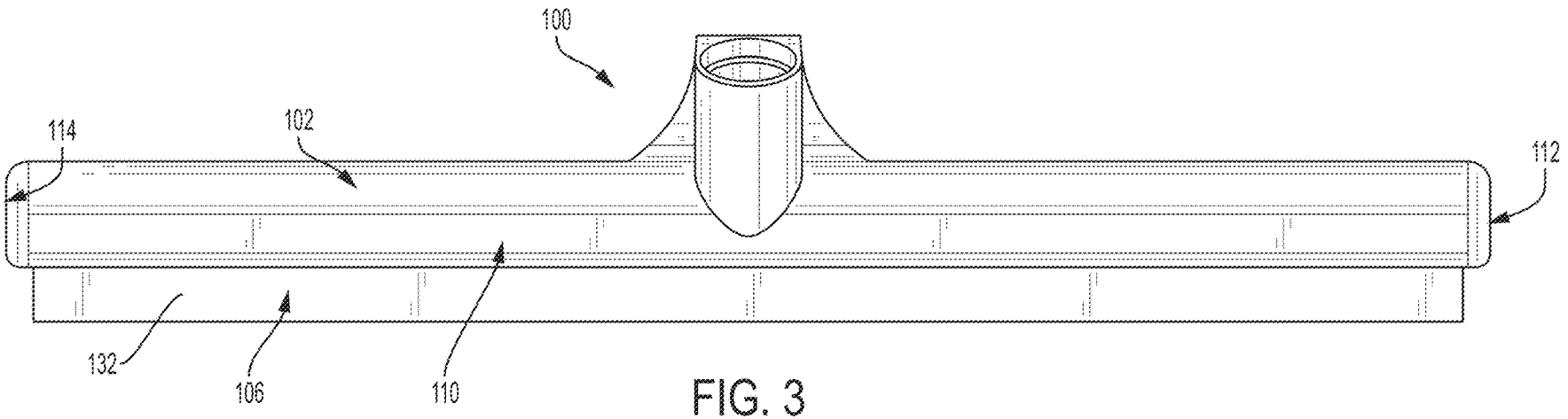
FIG. 3 is a rear view of the detailing tool shown in FIG. 1.
Figure 5:
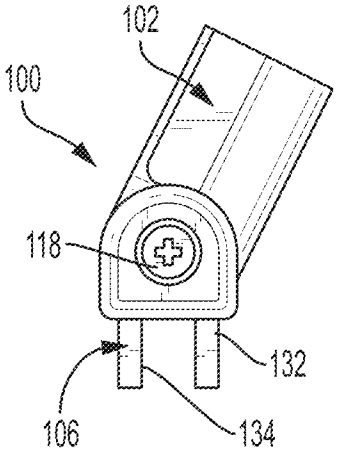
FIG. 5 is a left view of the detailing tool shown in FIG. 1.
Figure 4:
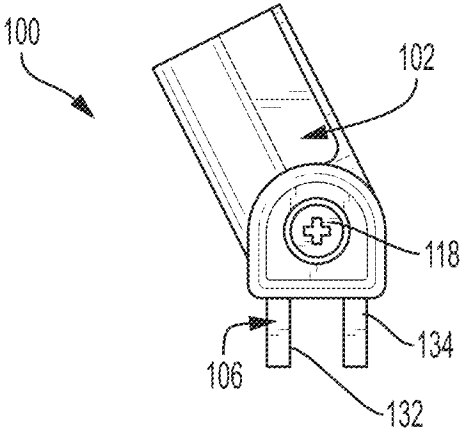
FIG. 4 is a right view of the detailing tool shown in FIG. 1.
Figure 6:
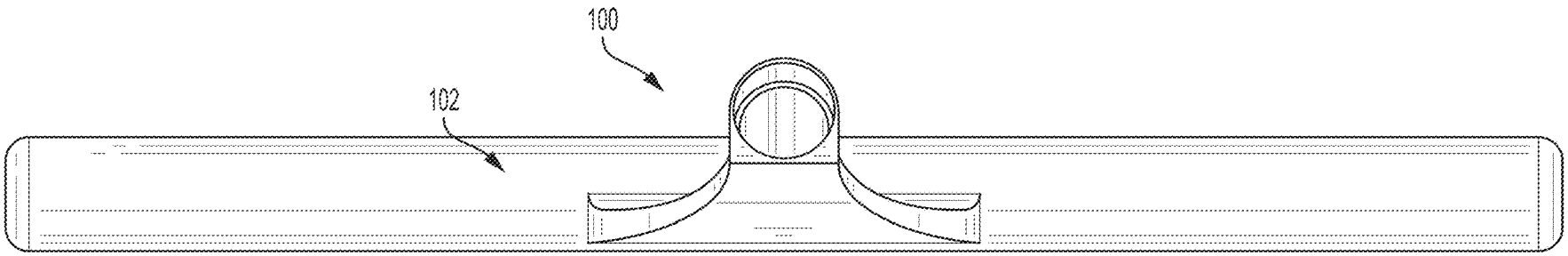
FIG. 6 is a top view of the detailing tool shown in FIG. 1.
Figure 7:
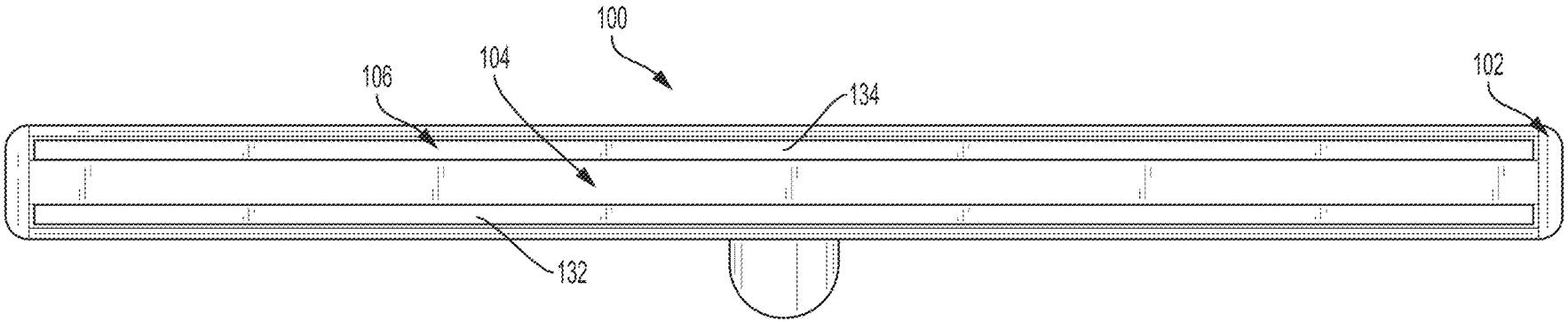
FIG. 7 is a bottom view of the detailing tool shown in FIG. 1.
Figure 8:
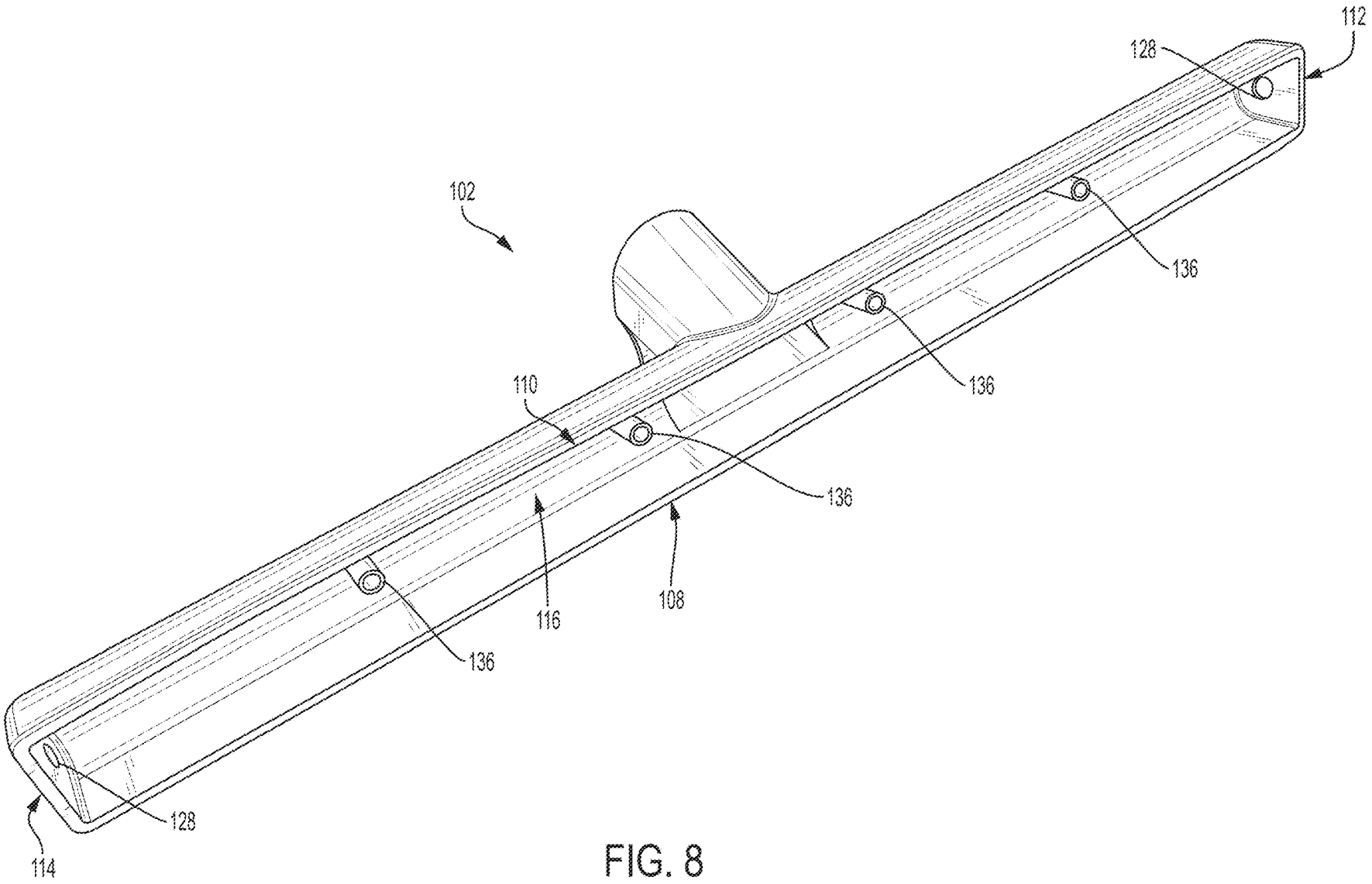
FIG. 8 is a bottom left perspective view of the detailing tool shown in FIG. 1 with the retaining member and the flexible blade member removed.
Figure 9:
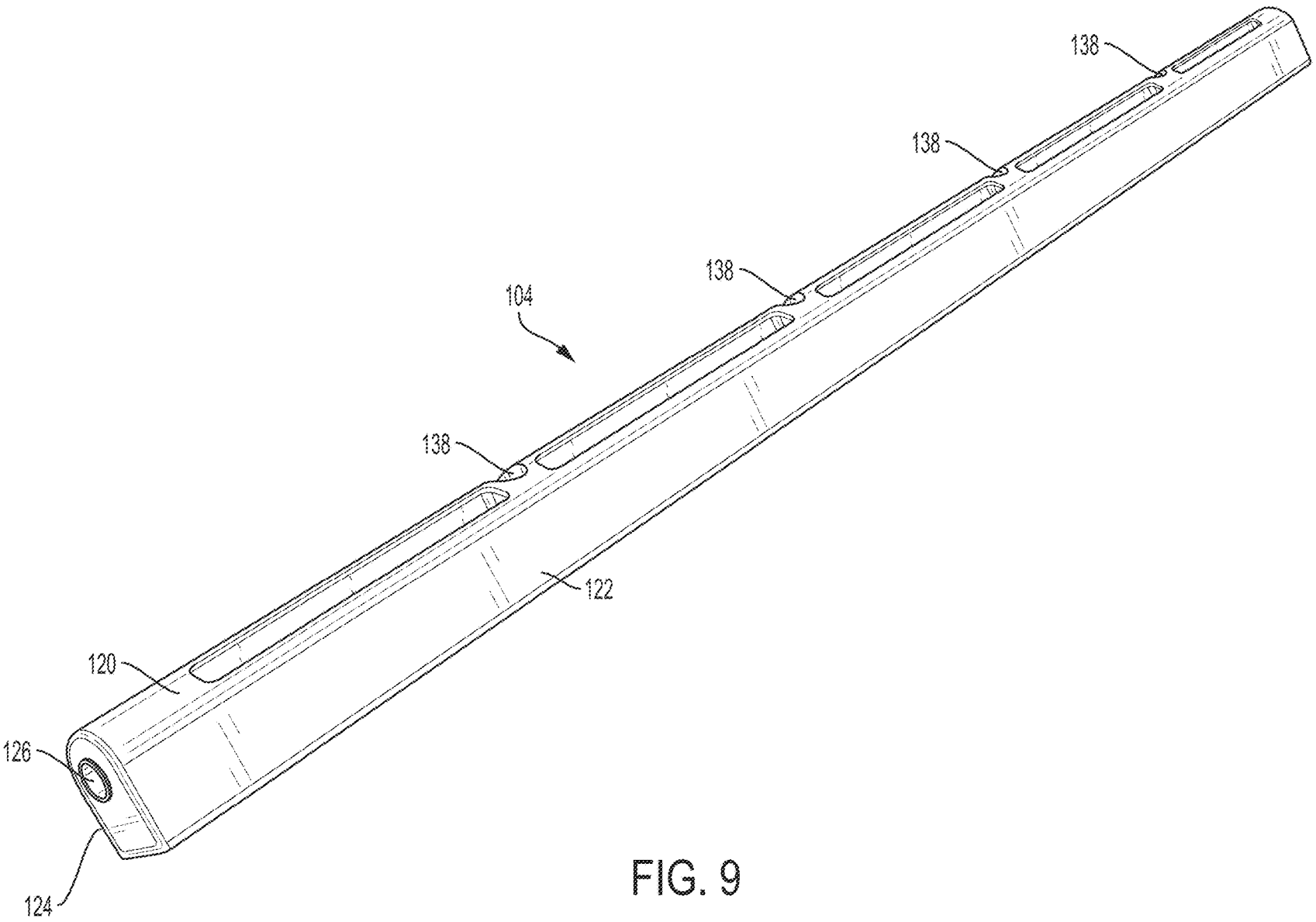
FIG. 9 is a top left perspective view of the retaining member shown in FIG. 8.
Figure 10:
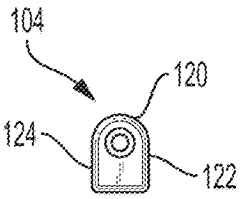
FIG. 10 is a side profile view of the retaining member shown in FIG. 8.
Figure 11:
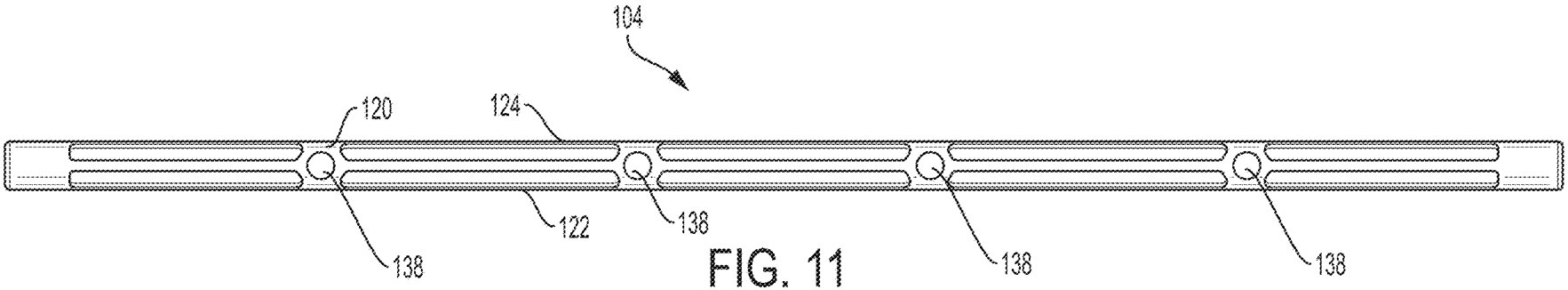
FIG. 11 is a top view of the retaining member shown in FIG. 8.

Reference numerals in the written specification and in the drawing figures indicate corresponding items.

DETAILED DESCRIPTION

An embodiment of a detailing tool in accordance with the present disclosure is indicated by reference numeral 100 in the figures. The detailing tool 100 includes a tool head 102, retaining member 104, and flexible blade member 106. The detailing tool allows a user to drag the flexible blade member 106 along a target surface to remove unwanted particles and water droplets which become temporarily adhered to the flexible blade member. To prevent damage to the flexible blade member 106, such as tearing, the detailing tool uses a multi-bladed configuration to spread stress across the flexible blade member.

The tool head 102 has a front side 108 spaced apart from an opposite rear side 110 across a width of the tool head. The tool head 102 has a first end 112 and a longitudinally opposite second end 114. The tool head 102 may have a cavity 116. The cavity may extend between the first end 112 and the second end 114, and may extend between the front side 108 and the rear side 110. The cavity 116 may be adapted and configured to receive the flexible member 106 within the cavity and the retaining member 104.

The retaining member 104 may be insertable into the cavity 116 and releasably secured to the tool head 102 using one or more fasteners 118. For example, and without limitation, the fasteners 118 may be screws, latches, snaps, magnetic fasteners, hook and loop fasteners, or any other suitable fastener. The retaining member 104 may have a curved upper surface 120, a straight rearward facing surface 122 extending downwardly from the curved upper surface, and a straight forward facing surface 124 extending downwardly from the curved upper surface opposite the straight rearward surface 122. The flexible blade member may be sufficiently flexible to conform to the retaining member 104. The retaining member 104 may further include one or more features for engaging with the fasteners 118 to secure the retaining member 104 to the tool head 102. For example, and without limitation, the retaining member 104 may have one or more threaded holes 126 corresponding to screw type fasteners 118. In such embodiments, the tool head 102 includes through holes 128 that permit the shaft but not the head of the fastener to pass through the tool head 102.

The flexible blade member 106 is sufficiently flexible and forms a pair of blades 130 when flexed and wrapped around the retaining member 104 and coupled to the tool head 102 using the retaining member. The pair of blades 130 include a rearward blade 132 and a forward blade 134. The pair of blades 130 may be formed from the flexible blade member 106 when the flexible blade member is positioned within the cavity 116 of the tool head 102. The flexible blade member 106 may be curved around the curved upper surface 120 of the retaining member 104 and positioned between the retaining member 104 and the tool head 102 with equal portions extending from the forward facing and rearward facing surfaces 122,124 of the retaining member to form the rearward blade 132 and the forward blade 134. The flexible blade member 106 may be sandwiched between the retaining member 104 and the tool head 102 such that the rearward blade 132 is between the rearward surface 122 of the retaining member 104 and a portion of tool head 102 defining the rear side 110 and the cavity 116. The flexible blade member 106 may be also sandwiched between the retaining member 104 and tool head 102 such that the forward blade 134 is between the forward surface 124 of the retaining member 104 and a portion of the tool head 102 defining the front side 108 and the cavity 116. The retaining member 104 positions the flexible blade member 106 in the cavity 116 and against the interior of the tool head 102 in this configuration in order to form the pair of blades 130. The retaining member may be received in the cavity as shown in the drawings, or in the alternative may be disposed outside of the cavity when releasably connected to the tool head.

The pair of blades 130 are adapted and configured to flex and engage a target surface such that unwanted particles adhere to the pair of blades 130 and are removed from the target surface. For example, the material of the pair of blades 130 may be polyurethane, which facilitates the adherence of unwanted particles. In some embodiments, the flexible blade member 106 which forms the pair of blades 130 is constructed from polyurethane preferably having a Shore hardness of between 46 and 54 on the Shore A durometer scale (conducted in accordance with ASTM D2240) and more particularly has a Shore hardness of 52 on the Shore A durometer scale (conducted in accordance with ASTM D2240). Such a hardness provides sufficient adherence to attach unwanted particles and maintain the integrity of the blade 18 (e.g., prevent tearing during use). In that regard, the flexible blade member may have a thickness of between about two millimeters and about four millimeters. In some embodiments, the polyurethane is between 80 and 90 percent polyester resin, between 0.5 and 2 percent trimethylolpropane, between 0.5 and 2.5 percent butanediol, between 1.5 and 3.5 percent 4,4'-Methylenebis(2-chloroaniline), and between 8 and 10 percent dioctyl phthalate. More preferably, the polyurethane is approximately 85 percent polyester resin, approximately 1.25 percent trimethylolpropane, approximately 1.5 percent butanediol, approximately 2.5 percent 4,4'-Methylenebis(2-chloroaniline), and approximately 9 percent dioctyl phthalate. In alternative embodiments, the pair of blades 130 has a different composition, polyurethane or otherwise.

In some embodiments, the tool head 102 includes a plurality of guide posts 136 to facilitate receiving the retaining member 104 in the cavity 116. Each guide post 136 extends downwardly from the tool head 102 and within the cavity 116. The plurality of guide posts 136 are adapted and configured to align the retaining member 104 with the tool head 102. For example, the guide posts 136 are aligned on a longitudinal axis parallel with the tool head 102. In one example, the retaining member 104 also includes a plurality of aligning holes 138 that extend along a longitudinal axis in the center of the retaining member. The plurality of aligning holes 138 of the retaining member are adapted and configured to receive the plurality of guide posts 136 such that the retaining member 104 aligns with the tool head 102. When the retaining member 104 is inserted into the cavity 116 of the tool head 102, the guide posts 136 enter the aligning holes 138 to position the retaining member 104 relative to the tool head 102.

Figure 12:
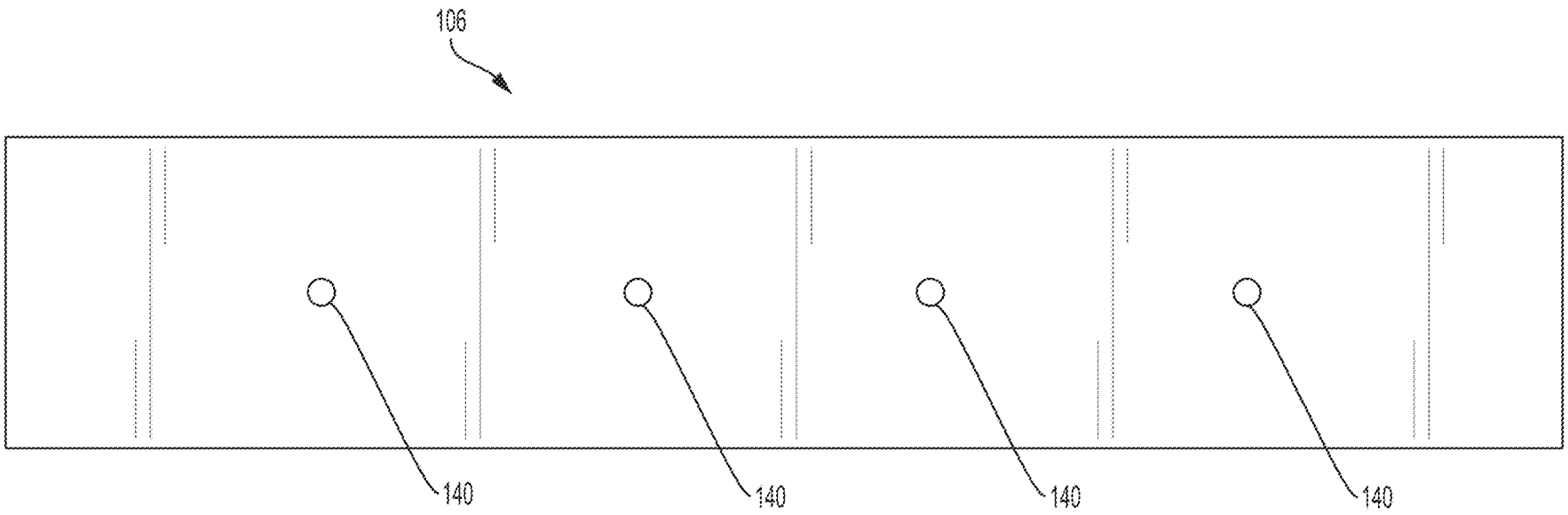
FIG. 12 is a top view of the flexible blade member shown in FIG. 1.

The flexible blade member 106 may also include a plurality of aligning through holes 140 adapted and configured to allow the plurality of guide posts 136 to extend through the plurality of through holes 140 such that the flexible blade member 106 is aligned with the tool head 102. The plurality of through holes 140 along with the plurality of guide posts 136 combine to stabilize the plurality of blades 130 when the detailing tool 100 is in use. For example, these features may limit or prevent shifting of the flexible blade member 106 relative to the tool head 102 and ensure the rearward and forward blades 132,134 are of equal length when assembled with retaining member 104 and inserted in the cavity 116. As shown in FIG. 12, the plurality of aligning holes 140 of the flexible blade member 106 extend along a longitudinal axis in the center of the flexible blade member.

The pair of blades 130 advantageously reduce the stress on flexible blade member 106 in comparison to a single blade configuration. This results in a decreased risk of the flexible blade member 106 tearing or breaking when the detailing tool 100 is in use. The pair of blades 130 are adapted and configured to contact the target surface when the detailing tool 100 is in use such that the force applied transmitted to the target surface from the detailing tool 100 is carried by both blades of the pair of blades 130. For example, when the detailing tool 100 is used, both blades of the pair of blades 130 contact the target surface and are flexed when dragged along the target surface. The force is transmitted through each blade to the tool head 102 as the flexible blade member 106 is sandwiched between the tool head 102 and the retaining member 104 such that the flexible blade member 106 is in contact with the tool head 102. In some embodiments, each blade of the pair of blades 130 has a thickness of between two millimeters and four millimeters, inclusive. This thickness may allow the blades to flex while maintaining the integrity of the blades. In alternative embodiments, the thickness may vary.

The releasable configuration of the flexible blade member 106 and the retaining member 104 advantageously allow for replacement of damaged blades by removing the flexible blade member 106 and replacing it with an undamaged replacement flexible blade member. The ability to remove the flexible blade member 106 may also facilitate cleaning of a used but undamaged flexible blade member 106, e.g., by rinsing or washing the flexible blade member 106 while removed from the detailing tool.

In alternative embodiments, the flexible blade member 106 may be releasably coupled to the tool head 102 using other suitable configurations. For example, and without limitation, the flexible blade member and the retaining member may be integrated into a cartridge or other configuration. A replacement cartridge may include a flexible blade member and a retaining member allowing both to be replaced. The cartridge may include other components such as a housing, shroud, cowl, or the like which receive the flexible blade member to form a pair of blades along with the retaining member of the cartridge. In such embodiments, the cavity of the tool head is sized to receive the cartridge. Alternatively, the tool head as a releasable fastener that engages with a corresponding feature on the housing or cartridge. The cartridge is typically disposable.

In the illustrated embodiment, the detailing tool 100 includes two blades. However, the same principles described herein permit the use of more than two blades. Additional blades may advantageously further spread the load amongst the blades to reduce damage to individual blades.

As various modifications could be made in the constructions and methods herein described and illustrated without departing from the scope of the disclosure, it is intended that all matter contained in the foregoing description or shown in the accompanying drawings shall be interpreted as illustrative rather than limiting. Thus, the breadth and scope of the present disclosure should not be limited by any of the above-described exemplary embodiments, but should be defined only in accordance with the following claims appended hereto and their equivalents.

It should also be understood that when introducing elements in the present disclosure in the claims or in the above description of exemplary embodiments of the disclosure, the terms "comprising," "including," and "having" are intended to be open-ended and mean that there may be additional elements other than the listed elements. Additionally, the term "portion" should be construed as meaning some or all of the item or element that it qualifies. Moreover, use of identifiers such as first, second, and third should not be construed in a manner imposing any relative position or time sequence between limitations.

What is claimed is:

1. A detailing tool comprising:

a tool head having a front side and a rear side spaced apart from the front side across a width of the tool head, the tool head having a first end wall and a second end wall spaced apart from the first end wall across a length of the tool head, the first and second end walls being orthogonal to the front and rear sides, the front side, rear side, first end wall, and second end wall defining a cavity in the tool head;

a flexible blade member comprising polyurethane having a Shore hardness of between 46 and 54 on the Shore A durometer scale, the flexible blade member having a thickness of between about two millimeters and about four millimeters; and a retaining member having a straight forward facing surface and a straight rearward facing surface spaced from the straight forward facing surface across a width of the retaining member, the straight forward facing surface matching and conforming to the front side of the tool head, the straight rearward facing surface matching and conforming to the rear side of the tool head, the retaining member being adapted and configured to releasably connect with the tool head at the first end wall of the tool head and at the second end wall of the tool head, and releasably secure the flexible blade member to the tool head;

wherein the flexible blade member is sufficiently flexible to be flexed around the retaining member;

wherein when the flexible blade member is flexed around the retaining member, inserted in the cavity of the tool head, and releasably secured to the tool head with the retaining member releasably connected to the first and second end walls of the tool head: (i) the flexible blade member forms first and second blades projecting from the tool head, (ii) the first and second blades of the flexible blade member extend along a direction corresponding to the length of the tool head in the cavity of the tool head; (iii) the first blade is spaced apart from the second blade along a direction corresponding to the width of the tool head; (iv) the retaining member is disposed between the first and second blades; (v) the retaining member spaces apart the first and second blades in the direction corresponding to the width of the tool head; (vi) the straight forward facing surface of the retaining member abuts the first blade against the front side of the tool head along the length of the tool head in the cavity of the tool head; (vii) and the straight rearward facing surface of the retaining member abuts the second blade against the rear side of the tool head along the length of the tool head in the cavity of the tool head.

2. The detailing tool in accordance with claim 1 further comprising a plurality of guide posts extending downwardly from the tool head within the cavity.

3. The detailing tool in accordance with claim 2, wherein the retaining member comprises a plurality of aligning holes adapted and configured to receive the plurality of guide posts.

4. The detailing tool in accordance with claim 2, wherein the flexible blade member comprises a plurality of aligning holes adapted and configured to receive the plurality of guide posts.

5. The detailing tool in accordance with claim 4, wherein the plurality of aligning holes of the flexible blade member extends across a center of the flexible blade member.

6. A detailing tool comprising:

a tool head having a front side and a rear side spaced apart from the front side across a width of the tool head, the tool head having a first end wall and a second end wall spaced apart from the first end wall across a length of the tool head, the first and second end walls being orthogonal to the front and rear sides, the front side, rear side, first end wall, and second end wall defining a cavity in the tool head;

first and second flexible blades disposed within the cavity and projecting from the tool head and extending along a direction corresponding to the length of the tool head with the first flexible blade spaced apart from the second flexible blade along a direction corresponding to the width of the tool head, the first blade being integral with second blade, the first and second blades comprising polyurethane having a Shore hardness of between 46 and 54 on the Shore A durometer scale, each of the first and second blades having a thickness of between about two millimeters and about four millimeters; and a retaining member having a straight forward facing surface and a straight rearward facing surface spaced from the straight forward facing surface across a width of the retaining member, the straight forward facing surface matching and conforming to the front side of the tool head in the cavity of the tool head, the straight rearward facing surface matching and conforming to the rear side of the tool head in the cavity of the tool head, the retaining member being releasably connectable with the first end wall of the tool head and the second end wall of the tool head and releasably securing the first and second blades to the tool head within the cavity of the tool head, the retaining member being disposed between the first and second flexible blades and spacing apart the first and second flexible blades in the direction corresponding to the width of the tool head along the length of the tool head in the cavity of the tool head in a manner where the straight forward facing surface of the retaining member abuts the first blade against the front side of the tool head along the length of the tool head in the cavity of the tool head, and the straight rearward facing surface of the retaining member abuts the second blade against the rear side of the tool head along the length of the tool head in the cavity of the tool head.

7. The detailing tool in accordance with claim 6 further comprising a plurality of guide posts extending downwardly from the tool head within the cavity.

8. The detailing tool in accordance with claim 7, wherein the retaining member comprises a plurality of aligning holes adapted and configured to receive the plurality of guide posts.

9. A method comprising:

providing a tool head having a front side and a rear side spaced apart from the front side across a width of the tool head, the tool head having a first end wall and a second end wall spaced apart from the first end across a length of the tool head, the first and second end walls being orthogonal to the front and rear sides, the front side, rear side, first end wall, and second end wall defining a cavity in the tool head;

providing a flexible blade member comprising polyurethane having a Shore hardness of between 46 and 54 on the Shore A durometer scale, the flexible blade member having a thickness of between about two millimeters and about four millimeters;

providing a retaining member, wherein the retaining member has a straight forward facing surface and a straight rearward facing surface spaced from the straight forward facing surface across a width of the retaining member, the straight forward facing surface matches and conforms to the front side of the tool head in the cavity of the tool head, the straight rearward facing surface matches and conforms to the rear side of the tool head in the cavity of the tool head, the retaining member is adapted and configured to releasably connect with the tool head and releasably secure the flexible blade member to the tool head; and releasably securing the flexible blade member to the tool head and forming first and second blade portions by flexing the flexible blade member around the retaining member, inserting the flexible blade member in the cavity of the tool head, and releasably connecting the retaining member to the first and second end walls of the tool head with: (i) the straight forward facing surface of the retaining member abutting the first blade portion against the front side of the tool head along the length of the tool head in the cavity of the tool head; (ii) the straight rearward facing surface of the retaining member abutting the second blade portion against the rear side of the tool head along the length of the tool head in the cavity of the tool head; (iii) the first and second flexible blade portions projecting from the tool head and extending along a direction corresponding to the length of the tool head; (iv) the first blade portion being spaced apart from the second blade portion along a direction corresponding to the width of the tool head; and (v) the retaining member being disposed between the first and second blade portions and spacing apart the first and second blade portions in the direction corresponding to the width of the tool head.

10. The method in accordance with claim 9, wherein:

the tool head has a plurality of guide posts extending downwardly from the tool head within the cavity;

the retaining member has a plurality of aligning holes adapted and configured to receive the plurality of guide posts; and the step of releasably securing the flexible blade member to the tool head includes aligning the plurality of guide posts with the plurality of aligning holes of the retaining member.

11. The method in accordance with claim 9, wherein:

the flexible blade member comprises a plurality of aligning holes adapted and configured to receive the plurality of guide posts; and the step of releasably securing the flexible blade to the tool head includes aligning the plurality of guide posts with the plurality of aligning holes of the flexible blade member.

12. The method in accordance with claim 9 further comprising:

providing a further flexible blade member, the further flexible blade member comprising polyurethane having a Shore hardness of between 46 and 54 on the Shore A durometer scale, the further flexible blade member having a thickness of between about two millimeters and about four millimeters;

removing the flexible blade member from the tool head by removing the retaining member; and releasably securing the further flexible blade member to the tool head and forming first and second blade portions of the further flexible blade member by flexing the further flexible blade member around the retaining member, inserting the further flexible blade member into the cavity of the tool head, and releasably connecting the retaining member to the first and second end walls of the tool head with: (vi) the straight forward facing surface of the retaining member abutting the first blade portion of the further flexible blade member against the front side of the tool head along the length of the tool head in the cavity of the tool head; (vii) the straight rearward facing surface of the retaining member abutting the second blade portion of the further flexible blade member against the rear side of the tool head along the length of the tool head; (viii) the first and second flexible blade portions of the further flexible blade member projecting from the tool head and extending along a direction corresponding to the length of the tool head; (ix) the first blade portion of the further flexible blade member being spaced apart from the second blade portion of the further flexible blade member along a direction corresponding to the width of the tool head; and (x) the retaining member being disposed between the first and second blade portions of the further flexible blade member and spacing apart the first and second blade portions of the further flexible blade member in the direction corresponding to the width of the tool head.

13. The method of claim 12 further comprising dragging the tool head across a target surface in a manner to engage the target surface with the first and second blade portions of the further flexible blade member and remove unwanted particles from the target surface with the first and second blade portions of the further flexible blade member.

14. The method of claim 9 further comprising dragging the tool head across a target surface in a manner to engage the target surface with the first and second blade portions of the flexible blade member and remove unwanted particles from the target surface with the first and second blade portions of the flexible blade member.

* * * * *